US007677902B2

(12) United States Patent
Irvine et al.

(10) Patent No.: US 7,677,902 B2
(45) Date of Patent: Mar. 16, 2010

(54) EXTENDED PACKAGE SUBSTRATE

(75) Inventors: James A. Irvine, Chandler, AZ (US); Tieyu Zheng, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 13 days.

(21) Appl. No.: 11/838,290

(22) Filed: Aug. 14, 2007

(65) Prior Publication Data

US 2008/0055825 A1 Mar. 6, 2008

Related U.S. Application Data

(63) Continuation of application No. 11/513,691, filed on Aug. 31, 2006, now Pat. No. 7,278,859.

(51) Int. Cl.
*H01R 12/00* (2006.01)

(52) U.S. Cl. ..... 439/71

(58) Field of Classification Search ..... 439/70, 439/71, 73, 60, 326, 330, 331, 630–634
See application file for complete search history.

(56) References Cited

U.S. PATENT DOCUMENTS

| | | | | |
|---|---|---|---|---|
| 5,176,524 | A | 1/1993 | Mizuno et al. | |
| 5,205,741 | A * | 4/1993 | Steen et al. | 439/70 |
| 5,305,188 | A | 4/1994 | Kubo | |
| 5,334,029 | A * | 8/1994 | Akkapeddi et al. | 439/66 |
| 5,479,110 | A | 12/1995 | Crane et al. | |
| 5,530,291 | A * | 6/1996 | Chan et al. | 257/723 |
| 5,571,021 | A | 11/1996 | Kawabe et al. | |
| 5,584,707 | A * | 12/1996 | Volz et al. | 439/72 |
| 5,755,585 | A * | 5/1998 | Cheng et al. | 439/326 |
| 5,980,267 | A | 11/1999 | Ayers et al. | |
| 6,164,998 | A * | 12/2000 | Poi et al. | 439/326 |
| 6,196,849 | B1 | 3/2001 | Goodwin | |
| 6,210,175 | B1 | 4/2001 | Payne | |
| 6,328,574 | B1 | 12/2001 | Howell et al. | |
| 6,497,582 | B1 | 12/2002 | Hoffmeyer | |
| 6,544,074 | B2 * | 4/2003 | Bricaud et al. | 439/630 |
| 6,699,047 | B1 * | 3/2004 | McHugh et al. | 439/71 |
| 6,731,517 | B1 * | 5/2004 | Yu | 361/807 |
| 6,746,253 | B1 | 6/2004 | Ma | |
| 6,776,640 | B2 * | 8/2004 | Nishioka | 439/325 |
| 6,802,728 | B1 | 10/2004 | Howell et al. | |
| 6,962,508 | B2 * | 11/2005 | Fang et al. | 439/630 |
| 6,971,887 | B1 * | 12/2005 | Trobough | 439/71 |
| 7,023,685 | B2 * | 4/2006 | Fujiyama et al. | 361/306.1 |
| 2003/0096514 | A1 | 5/2003 | Ho et al. | |
| 2003/0203664 | A1 * | 10/2003 | Koopman et al. | 439/71 |
| 2005/0014400 | A1 | 1/2005 | Liao et al. | |

OTHER PUBLICATIONS

"PCT International Search Report", dated Jan. 7, 2008 for PCT/US2007/076392, 3pgs.

* cited by examiner

*Primary Examiner*—T C Patel
*Assistant Examiner*—Harshad C Patel
(74) *Attorney, Agent, or Firm*—Buckley, Maschoff & Talwalkar LLC

(57) ABSTRACT

An apparatus may include an integrated circuit package comprising a plurality of conductive pads and having a face, and a socket coupled to the integrated circuit package and to the conductive pads, the socket having a footprint. In some aspects, the footprint is smaller than the face.

26 Claims, 6 Drawing Sheets

EXTENDED PACKAGE SUBSTRATE

CROSS REFERENCE TO RELATED APPLICATION

This is a continuation of co-pending prior U.S. patent application Ser. No. 11/513,691, filed Aug. 31, 2006.

BACKGROUND

An integrated circuit (IC) package consists of an IC die and an IC package substrate. The IC package substrate is used to electrically couple the IC die to external components and circuitry. Conventionally, electrical contacts of the IC die are coupled to electrical contacts of the IC package substrate, which are in turn electrically connected to external electrical contacts of the IC package substrate. The external electrical contacts of the IC package substrate may comprise pins, solder balls or other types of electrical contacts arranged in any suitable pattern.

The external contacts of an IC package substrate are typically coupled to a socket. Such a socket receives the IC package substrate and provides physical and electrical coupling of the IC package to a substrate such as a motherboard. For example, electrical contacts of an IC package may be removably coupled to first electrical contacts of a socket, and second electrical contacts of the socket may be coupled to electrical contacts of a substrate.

In order to ensure a good electrical connection between package substrate contacts and socket contacts, some architectures require the socket to firmly retain the IC package and to bias contacts of the IC package substrate against corresponding contacts of the socket. The structure of the IC package and the structure of the socket therefore closely depend on one another. Such dependence may reduce flexibility and/or interchangeability of IC package and socket designs.

DETAILED DESCRIPTION

Figure 1:
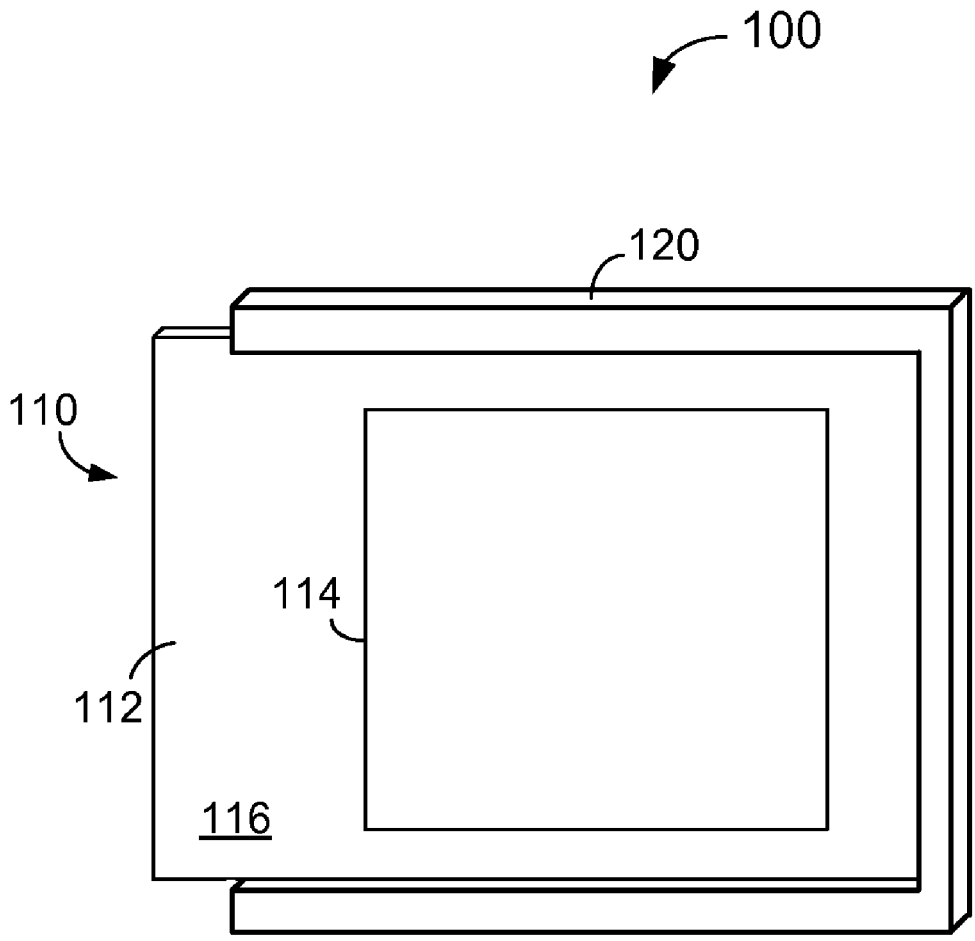
FIG. 1 is a perspective view of an apparatus according to some embodiments.

FIG. 1 is a perspective view of an apparatus according to some embodiments. Apparatus 100 comprises IC package 110 and socket 120. According to some embodiments, IC package 110 may comprise a microprocessor package and socket 120 may couple IC package 110 to a computing motherboard.

IC package 110 includes IC package substrate 112 and IC die 114. IC die 114 may comprise any other type of integrated circuit, including but not limited to a microprocessor, a network processor, a controller hub, and a chipset. IC die 114 may be covered by an integrated heat spreader or other protective element according to some embodiments.

IC package substrate 112 may comprise any ceramic, organic, and/or other suitable material. According to some embodiments, IC package substrate 112 comprises multiple stacked layers of dielectric material that are separated by planes of conductive traces. One plane of conductive traces may be coupled to one or more other planes of conductive traces by vias fabricated within the layers of dielectric material.

Figure 2:
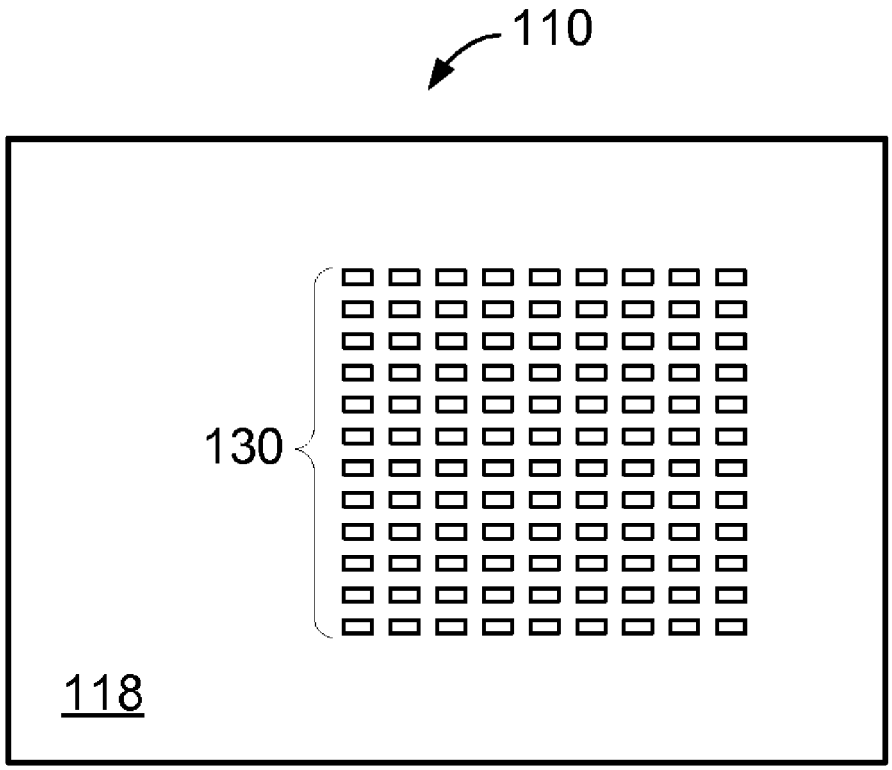
FIG. 2 is a bottom view of an IC package substrate according to some embodiments.

IC die 114 is coupled to face 116 of IC package substrate 112. Accordingly, face 116 of IC package substrate 112 may comprise electrical contacts (not shown) to which electrical contacts of IC die 114 (not shown) are coupled. FIG. 2 illustrates face 118 of IC package substrate 112, which is oriented toward socket 120 and is therefore not shown in FIG. 1. FIG. 2 also illustrates conductive pads 130 of IC package substrate 112. Conductive pads 130 may be arranged and structured to comply with the Land Grid Array and/or any other protocol.

Socket 120 may comprise any suitable material, including but not limited to a plastic material. Socket 120 may comprise a first set of electrical contacts (not shown in FIG. 1) exposed in a Land Grid Array arrangement. The first set of electrical contacts may comprise compression-type contacts such as a metal spring, and are to couple to respective ones of conductive pads 130. Socket 120 may also comprise a second set of electrical contacts (also not shown in FIG. 1) electrically connected to respective ones of the first set of electrical contacts. The second set of electrical contacts may comprise any contacts suitable for connection to a circuit board, including but not limited to solder balls and/or socket pins in an LGA arrangement. The aforementioned conductive traces and vias may thereby carry signals and power between electrical devices of IC die 114 and an external system to which socket 120 is coupled.

As shown in FIG. 1, a footprint of socket 120 is smaller than face 118 of IC package substrate 112. Consequently, IC package substrate 112 extends past socket 120 towards a left side of FIG. 1. Such an arrangement may facilitate the use of socket 120 to support one or more IC dies and/or other elements of various sizes.

Figure 3:
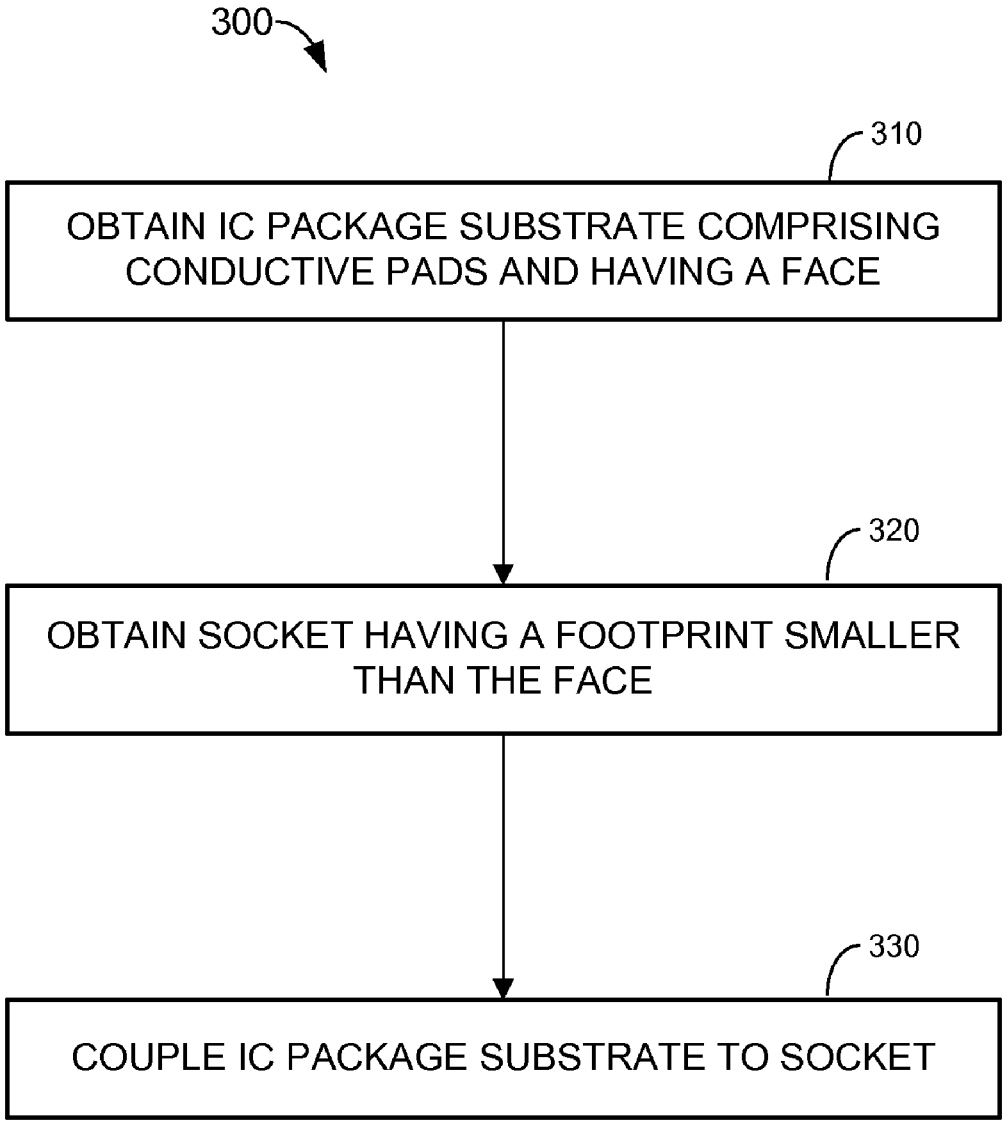
FIG. 3 is flow diagram of a process according to some embodiments.

FIG. 3 is a flow diagram of process 300 according to some embodiments. Process 300 may be performed by any number of systems, and some or all of process 300 may be performed manually. In some embodiments, process 300 is performed by a computer system integrator.

Initially, an IC package substrate is obtained at 310. The IC package substrate includes conductive pads and has a face. The IC package substrate may be fabricated at 310 and/or may be obtained from an integrated circuit package vendor. In some embodiments, a microprocessor package is received from a vendor at 310. IC package substrate 120 of FIGS. 1 and 2, including conductive pads 130 and face 118, may be obtained at 310 according to some embodiments.

A socket is obtained at 320. 320 may occur after, before, or during execution of 310 according to some embodiments. The socket exhibits a footprint smaller than the face of the IC package substrate. One example of this physical relationship is illustrated in FIG. 1. Several other examples will be provided below.

The IC package substrate is coupled to the socket at 330. Coupling at 330 may include aligning conductive pads 130 of IC package substrate 112 with corresponding electrical contacts of socket 120, and loading IC package 110 to bias conductive pads 130 against the electrical contacts of socket 120. Any currently- or hereafter-known system to load IC package 110 may be implemented. For example, a load plate of socket 120 (not shown) may be pivoted toward package 110 to bias pads 130 toward the electrical contacts of socket 120.

Figure 4B:
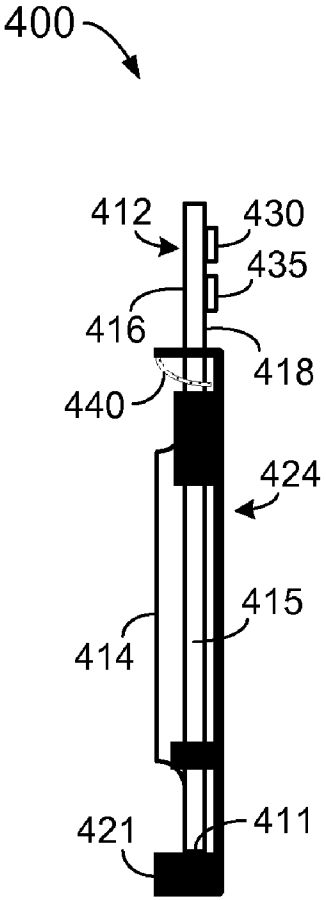
FIGS. 4A and 4B are a top view and a cross-sectional side view, respectively, of an apparatus according to some embodiments.
Figure 4A:
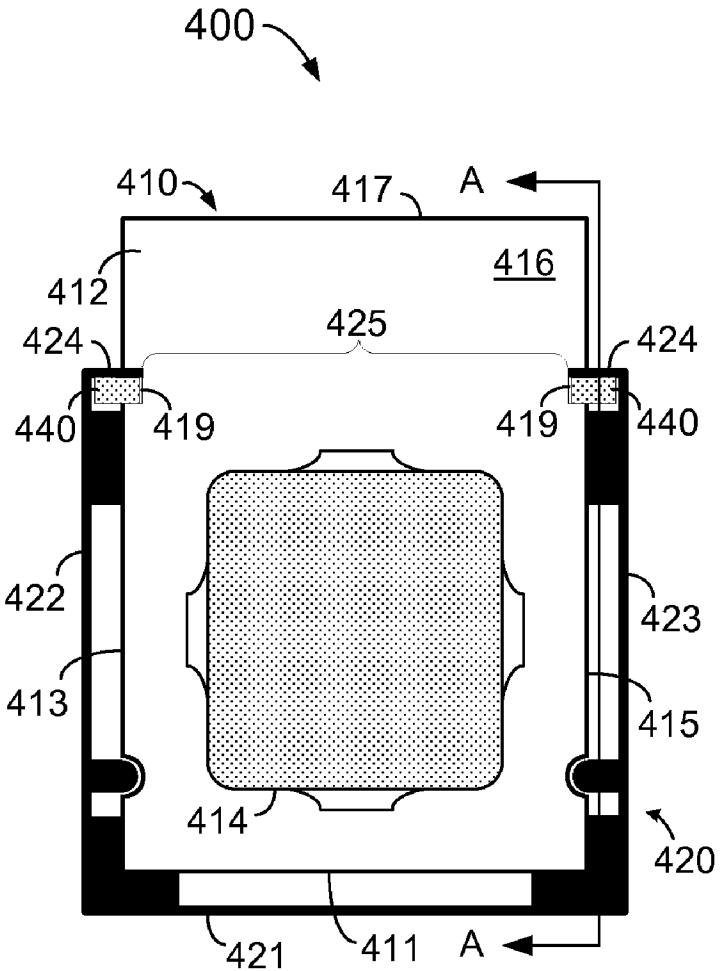

FIGS. 4A and 4B illustrate apparatus 400 according to some embodiments. Apparatus 400 comprises IC package 410 and socket 420. IC package 410, in turn, comprises IC package substrate 412 and IC die 414. IC die 414 as illustrated comprises an IC die as well as an integrated heat spreader covering the IC die.

IC package substrate 412 includes face 416 upon which IC die 414 is mounted. Face 418 faces socket 420 and is larger than a footprint of socket 420. A portion of IC package substrate 412 therefore extends past one side of socket 420, providing room for mounting IC die 430 and IC die 435 to face 418 or face 416 on the extended portion. IC die 430 and IC die 435 may comprise any electrical components, including but not limited to Read Only Memory, voltage regulators, and testing chips.

IC package substrate 412 includes first side 411, second side 413, third side 415 and fourth side 417. Socket 420 includes first wall 421, second wall 422, third wall 423 and fourth wall 424. A portion of first wall 421 is in contact with first side 411, and either a portion of second wall 422 is in contact with second side 413 or a portion of third wall 423 is in contact with third side 415. In some embodiments, the portion of second wall 422 is in contact with second side 413 and the portion of third wall 423 is in contact with third side 415 simultaneously.

Fourth wall 424 defines opening 425 through which the above-mentioned portion of IC package substrate 412 extends. As shown, opening 425 is disposed between first side 411 and fourth side 417 of IC package substrate 412.

Flexible members 440 are coupled to fourth wall 424 of socket 420. According to some embodiments, flexible members 440 are each to bias IC package substrate 412 towards first wall 421 of socket 420. In this regard, IC package substrate 412 defines notches 419 in which flexible members 440 are disposed and against which members 440 press. Flexible member 440 may comprise a metal spring and/or any other suitable element(s) that is or becomes known.

Figure 5:
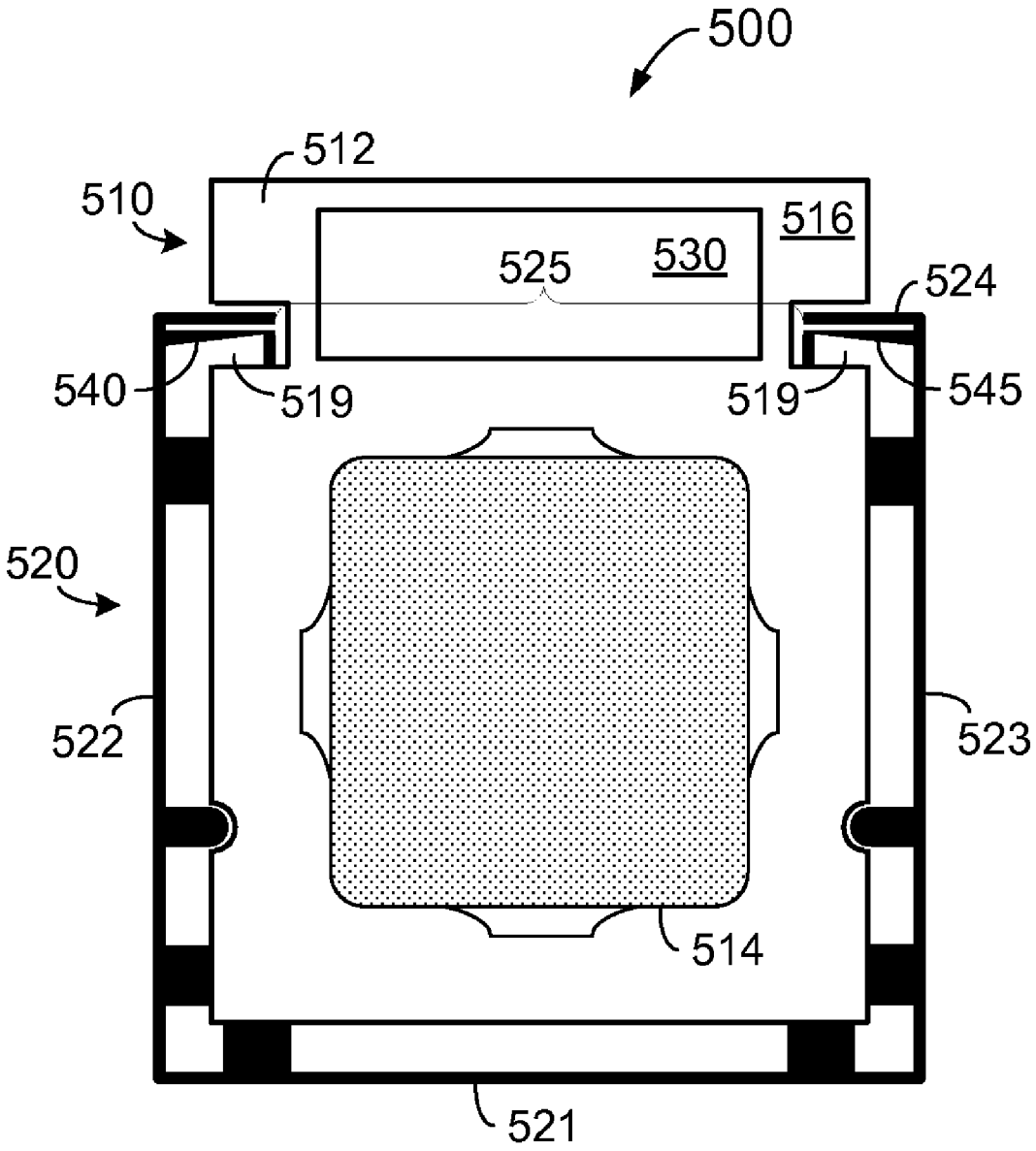
FIG. 5 is a top view of an apparatus according to some embodiments.

FIG. 5 is a top view of apparatus 500 according to some embodiments. Apparatus 500 comprises IC package 510 and socket 520. IC package 510 and socket 520 may comprise one or more of the features and attributes described above with respect to identically-named components. Such features and attributes will therefore not be repeated below.

IC package substrate 512 of IC package 510 defines notches 519 in which flexible members 540 and 545 are disposed. Each of flexible members 540 and 545 may serve to bias IC package substrate 512 towards first wall 521 of socket 520. Wall 524 of socket 520 may restrict backward movement of members 540 and 545 to an acceptable degree.

Flexible member 540 is coupled to wall 522 of socket 520 and may be integral therewith. Similarly, flexible member 545 is coupled to and may be integral with wall 523 of socket 520. In some embodiments, socket 520 is formed of cast metal, composite, ceramic, plastic, etc. Accordingly, members 540 and 545 may be cast along with the remaining integral elements of socket 520.

Apparatus 500 also includes IC die 530 mounted to face 516 of IC package substrate 512. At least a portion of IC die 530 is disposed within opening 525 defined by wall 524. In some embodiments, IC die 530 comprises an electrical connector interface. A ribbon cable or other conductive link (not shown) may be coupled to such an interface to provide communication between IC die 514 and external systems.

Figure 6:
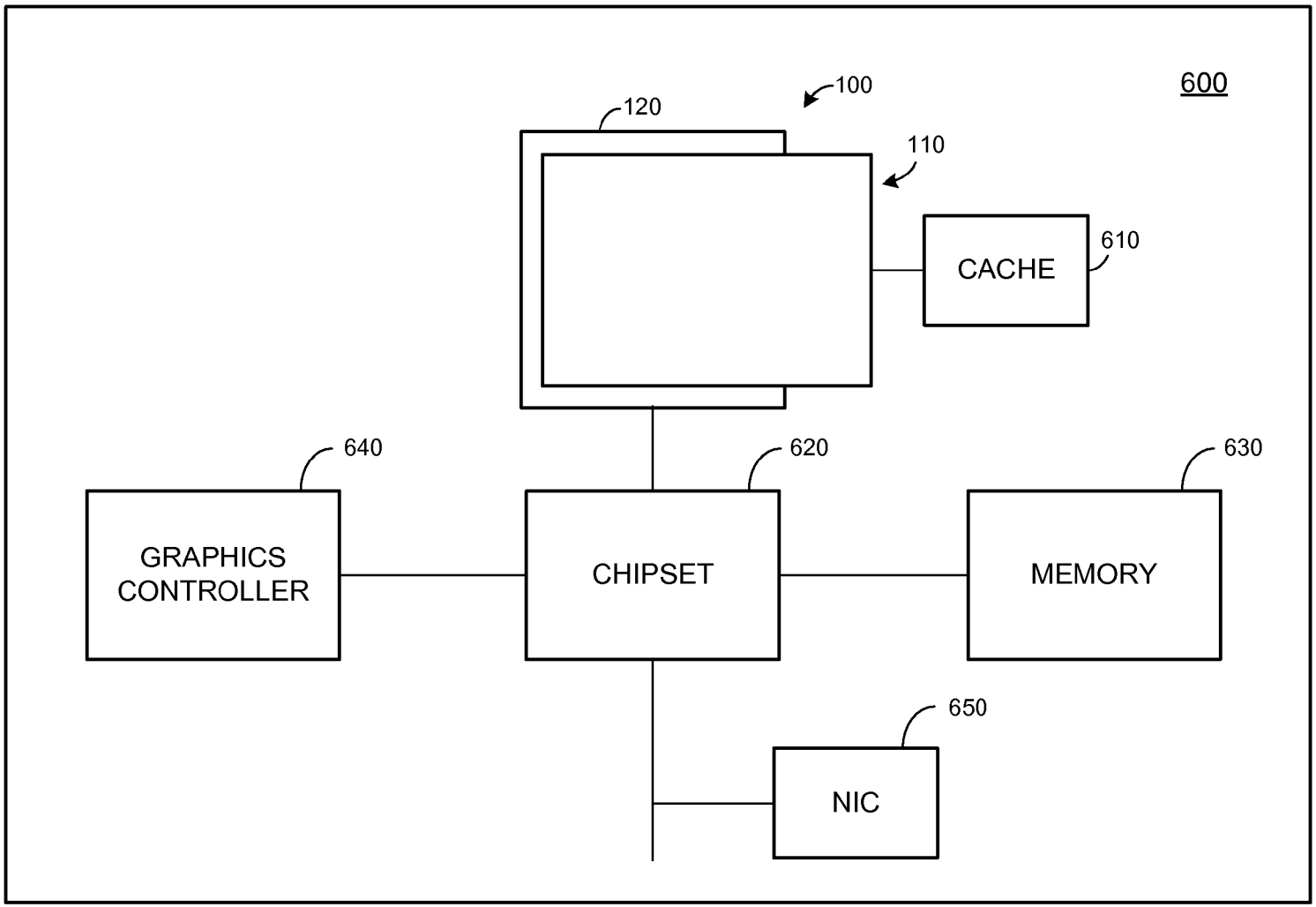
FIG. 6 is a block diagram of a system according to some embodiments.

FIG. 6 is a block diagram of system 600 according to some embodiments. System 600 may comprise components of a desktop computing platform. System 600 includes apparatus 100 of FIG. 1 and therefore includes IC package 110 and socket 120. IC package 110 may comprise a microprocessor or another type of integrated circuit, and may communicate with off-die cache 610. IC package 110 may also communicate with other elements via chipset 620. For example, chipset 620 may provide communication between IC package 110 and memory 630, graphics controller 640, and Network Interface Controller (NIC) 650. Memory 630 may comprise any type of memory for storing data, such as a Single Data Rate Random Access Memory, a Double Data Rate Random Access Memory, or a Programmable Read Only Memory.

The several embodiments described herein are solely for the purpose of illustration. Some embodiments may include any currently or hereafter-known versions of the elements described herein. Therefore, persons in the art will recognize from this description that other embodiments may be practiced with various modifications and alterations. For example, although embodiments have been discussed in reference to the mounting of an IC package to a circuit board through a socket, various components/devices other than an IC package may be mounted to various surfaces other than a circuit board by way of some embodiments. Also, although embodiments are discussed with reference to an IC package with Land Grid Array electrical contacts, embodiments may employ other types of electrical contacts.

What is claimed is:

1. A method comprising:

coupling a socket to an integrated circuit package comprising an integrated circuit package substrate and having a face, the socket having a footprint, the integrated circuit package substrate comprising a first side, a second side, a third side and a fourth side, the socket comprising a first wall in contact with the first side, a second wall in contact with the second side, a third wall in contact with the third side, and a fourth wall defining an opening, a portion of the integrated circuit package substrate extending through the opening, the face of the integrated circuit package substrate having a length extending from the first side of the integrated circuit package substrate to the fourth side of the integrated circuit package substrate, the footprint of the socket having a length extending from an outer side of the first wall to an outer side of the fourth wall, the length of the footprint of the socket being smaller than the length of the face of the integrated circuit package substrate; and biasing the integrated circuit package substrate towards the first wall of the socket using a flexible member, wherein the fourth wall of the socket restricts movement of the flexible member away from the first wall of the socket, wherein the integrated circuit package substrate defines a notch, and wherein at least a portion of the flexible member is disposed within the notch.

2. A method according to claim 1, wherein the opening is disposed between the first side of the integrated circuit package substrate and the fourth side of the integrated circuit package substrate.

3. A method according to claim 2, wherein the flexible member is coupled to the fourth wall of the socket.

4. A method according to claim 2, wherein the flexible member is coupled to the second wall of the socket.

5. A method according to claim 4, wherein the flexible member is integral with the second wall.

6. A method according to claim 5, wherein the flexible member is cast along with the second wall.

7. A method according to claim 5, wherein the flexible member is cast along with the second wall.

8. A method according to claim 2, wherein the integrated circuit package further comprises an integrated circuit die, wherein a second integrated circuit die is coupled to a second face of the integrated circuit package, wherein the integrated circuit die is coupled to the second face of the integrated circuit package, and wherein at least a portion of the second integrated circuit die is disposed within the opening.

9. A method according to claim 2, wherein the integrated circuit package further comprises an integrated circuit die, the method further comprising:

coupling an electrical connector interface to the integrated circuit package substrate, and coupling the integrated circuit die to the integrated circuit package substrate.

10. A method according to claim 1, wherein the integrated circuit package comprises electrical contacts.

11. A method according to claim 10, wherein the electrical contacts comprise electrical contacts arranged to comply with a Land Grid array protocol.

12. A method according to claim 10, the method further comprising:

coupling the socket to the electrical contacts of the integrated circuit package.

13. A method according to claim 12, wherein the socket comprises electrical contacts, and wherein coupling the socket to the electrical contacts of the integrated circuit package comprises:

coupling the electrical contacts of the socket to respective ones of the electrical contacts of the integrated circuit package.

14. A method according to claim 12, wherein the opening is disposed between the first side of the integrated circuit package substrate and the fourth side of the integrated circuit package substrate.

15. A method according to claim 14, wherein the flexible member is coupled to the fourth wall of the socket.

16. A method according to claim 14, wherein the flexible member is coupled to the second wall of the socket.

17. A method according to claim 16, wherein the flexible member is integral with the second wall.

18. A method according to claim 14, wherein the integrated circuit package further comprises an integrated circuit die, wherein a second integrated circuit die is coupled to a second face of the integrated circuit package, wherein the integrated circuit die is coupled to the second face of the integrated circuit package, and wherein at least a portion of the second integrated circuit die is disposed within the opening.

19. A method according to claim 14, wherein the integrated circuit package further comprises an integrated circuit die, the method further comprising:

coupling an electrical connector interface to the integrated circuit package substrate, and coupling the integrated circuit die to the integrated circuit package substrate.

20. A method according to claim 12, further comprising coupling the socket to a circuit board.

21. A method according to claim 20, wherein coupling the socket to a circuit board comprises:

coupling the socket to a computing motherboard.

22. A method according to claim 1, wherein the integrated circuit package comprises electrical contacts.

23. A method according to claim 22, wherein the electrical contacts comprise electrical contacts arranged to comply with a Land Grid array protocol.

24. A method according to claim 22, the method further comprising:

coupling the socket to the electrical contacts of the integrated circuit package.

25. A method according to claim 24, wherein the socket comprises electrical contacts, and wherein coupling the socket to the electrical contacts of the integrated circuit package comprises:

coupling the electrical contacts of the socket to respective ones of the electrical contacts of the integrated circuit package.

26. A method according to claim 1, further comprising:

biasing the integrated circuit package substrate using a second flexible member, wherein the integrated circuit package substrate defines a second notch, and wherein at least a portion of the second flexible member is disposed within the second notch.

* * * * *